United States Patent [19]

Lohse

[11] Patent Number: 4,930,557

[45] Date of Patent: Jun. 5, 1990

[54] COVERING FOR LARGE, HEAVY OBJECTS IN PARTICULAR MILITARY EQUIPMENT

[76] Inventor: Jürgen Lohse, Norderstedter Strasse 88A, D-2359 Henstedt-Ulzburg, Fed. Rep. of Germany

[21] Appl. No.: 110,786

[22] Filed: Oct. 21, 1987

Related U.S. Application Data

[63] Continuation-in-part of Ser. No. 752,181, filed as PCT EP84/00369 on Nov. 24, 1984, published as WO85/02386 on Jun. 6, 1985, abandoned.

[30] Foreign Application Priority Data

Dec. 3, 1983 [DE] Fed. Rep. of Germany ..... 3343813

[51] Int. Cl.[5] ..... B65D 75/04; B65D 75/28; B65D 85/68

[52] U.S. Cl. ..... 150/166; 135/88; 206/335

[58] Field of Search ..... 150/52 R, 52 K, 154, 150/166; 206/335; 296/136; 135/88, 119

[56] References Cited

U.S. PATENT DOCUMENTS

| | | | |
|---|---|---|---|
| 844,220 | 2/1907 | Westbrooke | 135/87 X |
| 897,594 | 9/1908 | Craw | 383/68 |
| 1,164,853 | 12/1915 | O'Donnell | 135/87 X |
| 1,303,723 | 5/1919 | Porter | 383/68 X |
| 1,383,809 | 7/1921 | Howard | 229/93 X |
| 1,902,764 | 3/1933 | De Give | 383/68 X |
| 2,032,880 | 3/1936 | Kinsley et al. | 383/68 X |
| 2,608,198 | 8/1952 | Goodman | 150/166 X |
| 2,688,973 | 9/1954 | Reiman | 135/105 |
| 3,069,737 | 12/1962 | Schneider et al. | 24/459 X |
| 3,101,109 | 8/1963 | Hawley et al. | 150/52 R |
| 3,474,803 | 10/1969 | Davis | 150/52 K X |
| 3,650,416 | 3/1972 | Bodenheimer | 206/335 X |
| 3,700,019 | 10/1972 | Robbins et al. | 150/52 R X |
| 3,783,766 | 1/1974 | Boucher | 150/52 R X |
| 3,820,651 | 6/1974 | Levy | 150/52 R X |
| 4,114,668 | 9/1978 | Hickey | 150/52 R X |
| 4,149,578 | 4/1979 | Hickey | 150/52 R X |
| 4,447,935 | 5/1984 | Ausnit | 24/459 X |

FOREIGN PATENT DOCUMENTS

| | | | |
|---|---|---|---|
| 134074 | 3/1985 | European Pat. Off. | 206/335 |
| 2320207 | 11/1974 | Fed. Rep. of Germany | 206/335 |
| 1136312 | 5/1957 | France . | |
| 2490597 | 3/1982 | France . | |
| 7148 | of 1892 | United Kingdom | 296/136 |
| 851966 | 10/1960 | United Kingdom | 150/52 K |
| 2038776 | 7/1980 | United Kingdom . | |

*Primary Examiner*—Sue A. Weaver
*Attorney, Agent, or Firm*—Lane & Aitken

[57] ABSTRACT

A tube made of flexible tarpaulins or sheeting as a covering for relatively large objects for the purpose of long-term storage. The tube is provided on the outer circumference with attachments for the application of force to enable the tube to be raised to its proper shape, thus allowing entry of the object. The tube then only requires to be closed at its ends by means of removable clamps.

15 Claims, 5 Drawing Sheets

COVERING FOR LARGE, HEAVY OBJECTS IN PARTICULAR MILITARY EQUIPMENT

CROSS REFERENCE TO RELATED APPLICATION

This is a continuation-in-part of Ser. No. 752,181, filed as PCT FP84/00369 on Nov. 24, 1984, published as WO85/02386 on Jun. 6, 1985 now abandoned.

BACKGROUND OF THE INVENTION

The invention is concerned with a covering for large, heavy objects and, more particularly, to covers for the long term storage of military equipment, armored cars, vehicles and the like.

It is a known practice, as can be seen from published United Kingdom Patent Application No. 2,038,776A and German Offenlegungsschrift No. 2,206,819, to cover vehicles, e.g., military equipment and armored cars, during non-use with sheeting, to ensure that these items of equipment can be stored for longer periods without showing signs of corrosion. This is carried out by standing the vehicle on a ground sheet which is bounded by a frame. The vehicle is then covered with a second sheet or tarpaulin, the ends of the sheet being attached to the frame. It is almost impossible to ensure lasting impermeability. Any unsoundness, however, allows dampness to penetrate, with the result that the menace of corrosion cannot be prevented. Difficulties are also encountered in spreading the sheet over the standing vehicle in such a way that it is not damaged or overstretched in places.

In the case of another known covering of this type, as is disclosed in German Offenlegungsschrift No. 2,344,034, individual lengths of sheeting are first joined by welding the edges together to form an envelope. The object to be stored is then placed on one part of the envelope and the latter is drawn over to cover the object and then tightly closed. The aforementioned problems involved in handling the cover are also encountered here.

The main disadvantage of all known coverings is the fact that the length of the areas to be closed is relatively great, thus increasing the likelihood of leaks in the course of time. Account must also be taken here of the fact that even-surfaced sheeting is used to cover objects of uneven shape, inevitably causing the sheeting to crease, which again leads to difficulties when closing the cover.

SUMMARY OF THE INVENTION

The purpose of the invention is to design a covering of the type initially mentioned in such a way that it is easy to handle, that no damage and overstretching of the sheeting can occur during the actual wrapping procedure, and that closure of the covering presents no problems.

This is accomplished by the characteristics detailed in the patent claims.

The invention is essentially based on the use of a tube. This can be formed seamless by an injection blow process, or by welding or otherwise fixing lengths of sheeting together, either lengthwise or spirally.

The tube is spread out lengthwise and, with the aid of the attachments for application of force located on the outer circumference, is lifted into its proper tubular shape by a suitable device. Crane equipment can be used for this purpose, for instance, or else a special device which, when connected to the attachments for application of force, turns to lift the tube into the proper, open tube shape. In this position, a vehicle can be conveyed into the inside of the tube. The ends of the tube now only require to be securely joined to one another so that the object enclosed within is tightly sealed off from its environment. The length of the area to be sealed is comparatively small in relation to that of other known coverings.

The ends of the tubular covering can also be sealed using conventional devices. It is possible to use devices whose main feature is a slot to accommodate the tube ends. The slot is then constricted by a suitable arrangement, producing a clamped bond which is secure but capable of being reopened. With this invention, the bond should preferably be a straight one. However, it is also possible to cut out the ends of the tube to form a bond of the type frequently seen in cardboard boxes or collapsible boxes.

Handling of the tube end can also be facilitated by providing the tube with adhesive connecting elements such as magnetic tapes or Velcro tapes. These connecting elements enable the ends of the tube to be aligned with one another and kept in a fixed position for clamping, without having to hold the sheeting itself in the required position while the clamp is being applied.

One material suitable for coverings is PVC, being cheap and sufficiently robust to allow the use of relatively thin sheeting. However, this type of sheeting has too high a grade of permeability.

Butyl rubber is also used but, being less robust, it requires being made up into considerably thicker sheets. Butyl rubber is admittedly much less permeable to water than PVC, but is more difficult to handle on account of its greater thickness.

A description of the invention is given below and should be read in conjunction with the diagram.

DETAILED DESCRIPTION OF THE PREFERRED EMBODIMENTS

In the figures, 10 denotes the tube used in accordance with the invention.

Figure 1:
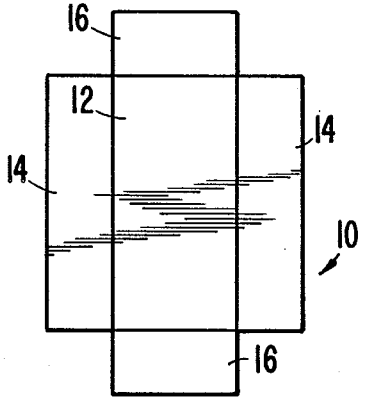
FIGS. 1 to 3 show views of one version of the covering according to the invention.
Figure 2:
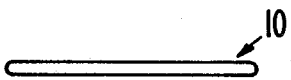
Figure 3:
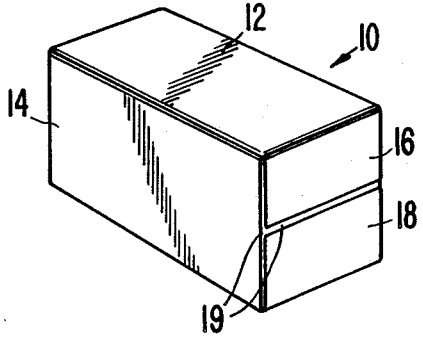

FIG. 1 shows a top view. FIG. 2 shows a front view of the tube, spread flat, but not expanded. FIG. 3 shows the position in which the tube can be used to store objects. The tube 10 includes a top 12, a bottom (not shown) identical to the top 12, first and second sides 14 (only the top halves of which are visible in FIG. 1), rectangular top end flaps 16 which project beyond and fold down from the top 12, and rectangular bottom end flaps 18 which project beyond and fold up from the bottom. The length of each of the top and bottom end flaps 16 and 18 is about one-half of the height of the first and second sides 14, so that end edges of the top and bottom end flaps 16 and 18 practically meet midway up the ends of the tube 10 and define an H-shaped configuration 19 with the end of the tube for sealing at each end of the tube.

Figure 4:
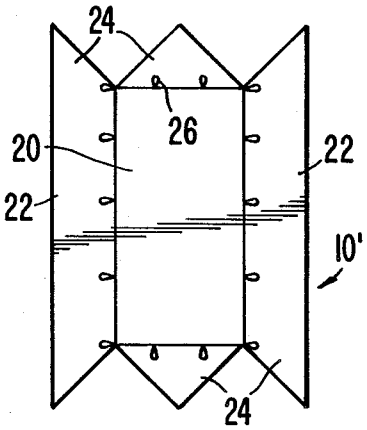
FIGS. 4 to 6 show views of another version of the covering according to the invention.
Figure 5:
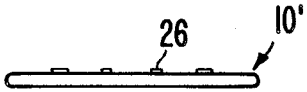

FIG. 4 shows a top view of a modified tube version 10' where the ends are cut out in a certain way. FIG. 5 shows a front view and FIG. 6 a graphic representation detailing the way in which the cut parts of the tube end can be drawn together so that the clamps can outwardly seal off the tubular receptacle. The tube 10' includes a top 20, a bottom (not shown) identical to the top, first and second sides 22 (only the top halves of which are visible in FIG. 4), and triangular end flaps 24 which project beyond each of the top 20, bottom, and first and second sides 22, and fold toward the center of each end of the tube 10' to define an X-shaped sealing region 25 in which edges of each triangular end flap 24 lie parallel to and just slightly spaced from edges of the adjacent end flaps.

Figure 7:
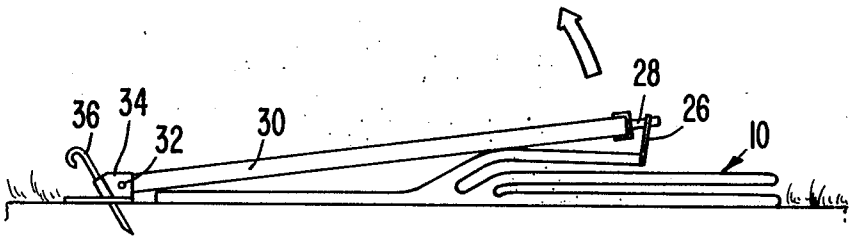
FIG. 7 shows a view of a tube according to the invention, spread flat.

FIG. 7 shows a front view of a tube 10 spread out on the ground. A large number of loops 26 are attached to the outer circumference of the tube for the insertion of pegs 28. The pegs 28 are located on a hinged part 30, the latter being hinged at 32 to support plates 34 which are fixed to the ground by stakes 36. The hinge itself is fixed to the ground with the usual equipment.

Figure 8:
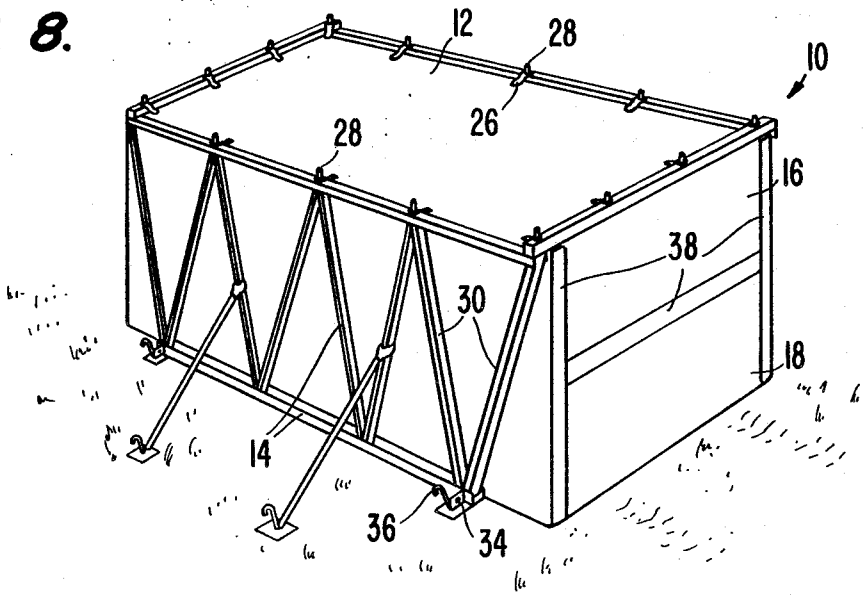
FIG. 8 shows a view of the raised tube and of the raising device according to the invention.

FIG. 8 shows the position reached on lifting the outspread tube 10 into the raised position by means of the hinged parts 34. It can be seen that the loops 26 and the pegs 28 are located on both sides of the tube 10 and that the turning movement shown in FIG. 7 has been repeated in the opposite direction to the right of the tube 10. These lifting actions result in the boxlike structure shown in FIG. 8, whose open ends can be sealed by means of clamps 38. It is not necessary for the hinged parts 34 to remain attached to the tube 10. They can be removed to allow the tube 10 to drop over the enclosed object.

Figure 6:
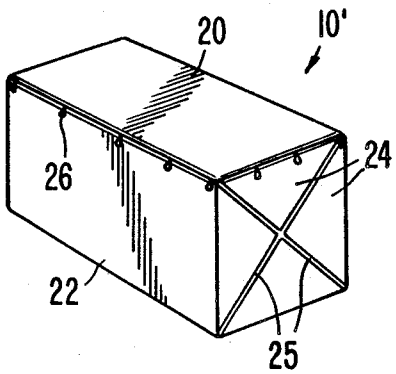
Figure 9:
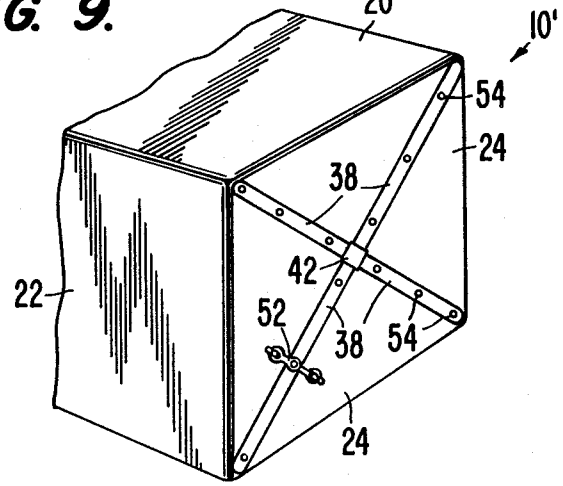
FIG. 9 shows an end view of the covering according to the invention.

FIG. 9 demonstrates how the tube 10' shown in FIG. 6 can be sealed by means of the clamps 38. In this case, the clamps 38 take the form of four straight clamps connected by a special part 42 at the center of the cross.

Figure 11:
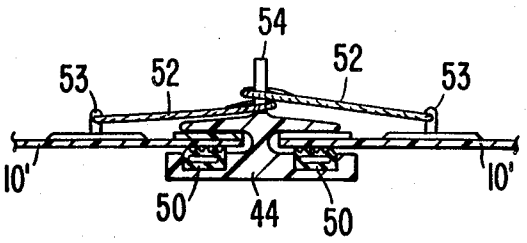
FIGS. 10 to 12 show clamps for the ends of the tube.
Figure 10:
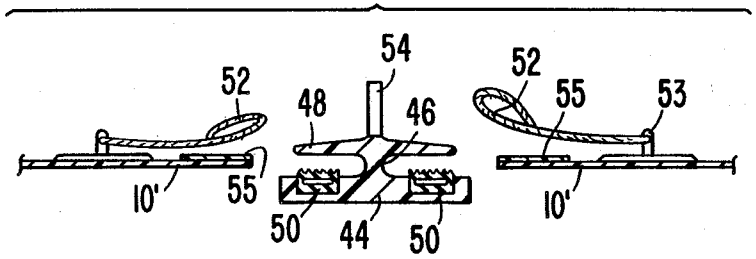

FIGS. 10 and 11 show the clamp 38, one view showing the position prior to clamping, and the other view showing the sheeting clamped. The essential features of the clamp 38 are its straight linear extension, a base 44, a medial ridge 46 and a cross member 48 extending across the top of the medial ridge 46 to define slots with the base 44. The slots contain compressible parts 50, of the type having a chamber for the application of pressurized gas which are commonly used in connection with fixing and sealing tarpaulins. The ends of the tube 10 are inserted into the slots, this procedure being assisted by loops 52 which are fixed to the tube 10' along the edges of the triangular end flaps 24 by attachments 53, which are secured to the tube 10' by gluing or welding. The loops 52 are placed over a peg 54 or similar element on clamp 20, and the compressible parts 50 are expanded by applying pressurized gas so that the overall result is a robust, leakproof bond. Although two loops 52 are shown cooperating with a peg 54 in FIG. 9, it is understood that additional loops 52 are spaced along the edges of the triangular end flaps 24 in positions adjacent to the other pegs 54 on the clamps 40 and are omitted from FIG. 9 for clarity of illustration. Strips 55 of material, particularly the same material as the tube 10', are fixed to the edges of the tube 10', for example, by welding or glue, to increase the strength of the edges.

Figure 12:
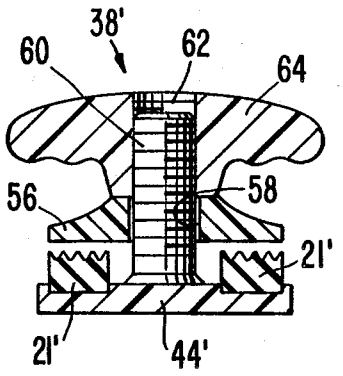

Another version of a clamp 38 is shown as a cross-section in FIG. 12. In this version, a base 44' is fitted on an upper surface with elastic sealing strips 21' which do not have gas chambers but rely instead on the resilience of the material to apply a suitable retaining force along the edges of the flaps. Located opposite these is a strip-like part 56 having apertures 58 through which threaded bolts 60 secured to the base 44' extend to be received in bores 62 in rotary knobs 64. When the tube ends are inserted into the slots defined between the base 44' and the strip-like part 56, the knobs 64 are turned to create a robust and leakproof bond. The clamps 38' can be used instead of the clamps 38 in the various embodiments of the invention.

Figure 16:
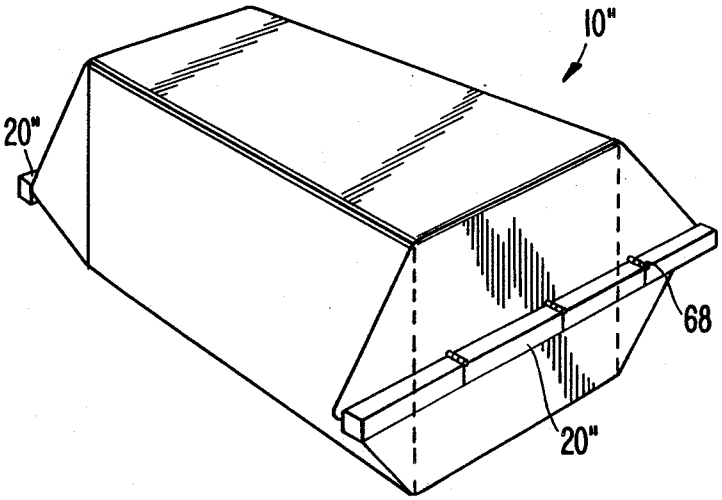
FIG. 16 shows a view corresponding to FIG. 15 but with the inclusion of the clamps.
Figure 14:
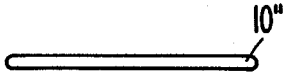
FIGS. 13 to 15 show views of another version according to the invention.
Figure 13:
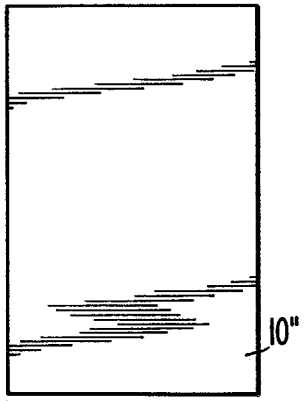
Figure 15:
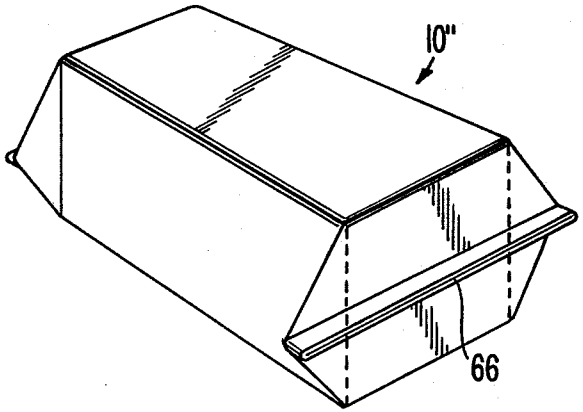

FIG. 13 shows a top view and FIG. 14 a front view of a tube 10'' laid out flat. FIG. 15 shows the tube 10'' in the expanded position, each of the tube ends being drawn together to form a single straight line 66 which can be tightly secured by a clamp 20'' which is shown in FIG. 16.

Figure 17:
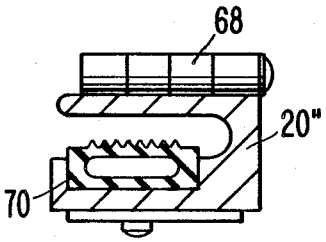
FIG. 17 shows a cross-section through a clamp of the type used as detailed in FIG. 16.

The clamp 20'' is divided into individual sections by hinges 68 to facilitate handling of the clamp parts. FIG. 17 shows a cross-section of the clamp 20'' as shown in FIG. 16. Here again one can see the slot into which the tube 10 ends lying along the line 66 are inserted. An expanding part 70 is also shown which, when expanded by gas pressure, extends over the length of the clamp 20'' and includes a closed chamber containing a gas tending to expand the chamber and thereby bias the sealing part 70 against the tube ends, sealing the tube ends to create a robust, leakproof bond.

Figure 18:
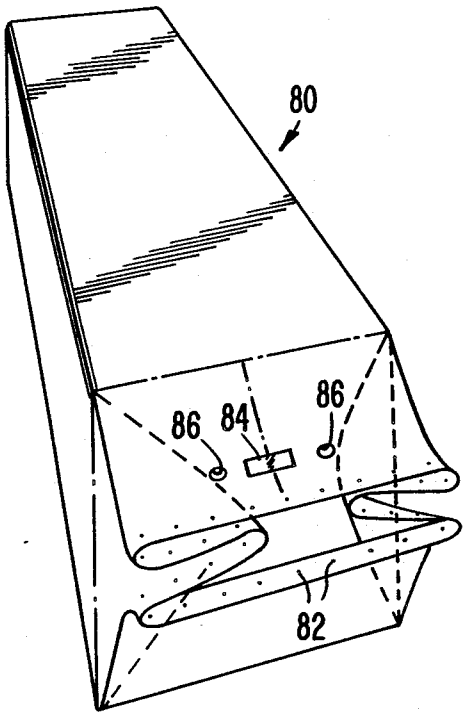
FIG. 18 shows a perspective view of yet another version of the covering according to the invention.

FIG. 18 shows, as another version of the covering according to the present invention, a tube 80 folded at its ends in the manner of figure "H". By means of the H-fold, the length of the clamp needed to seal the end of the tube 80 is restricted to a small part of the circumferential length of the end of the tube, and the end of the tube is adapted for sealing by a straight clamp. More specifically, the length of the clamp needed is considerably less than one-half of the circumferential length of the end of the tube 80. The clamp 20'' can be used to seal the H-fold of FIG. 18. Holes 82 are provided at the ends of the tube 80 to receive fasteners such as bolts, in case nuts and bolts are used in pressing the edges of the tube 80 together. A window 84 is positioned near the end of the tube 80 for looking inside the tube 80, and openings 86 are also included to receive a pipe or tube for feeding compressed air into the interior of the tube 80. Of course, the holes 82, the window 84, and the openings 86 can be provided in the other embodiments of the tube according to the present invention.

Figure 19:
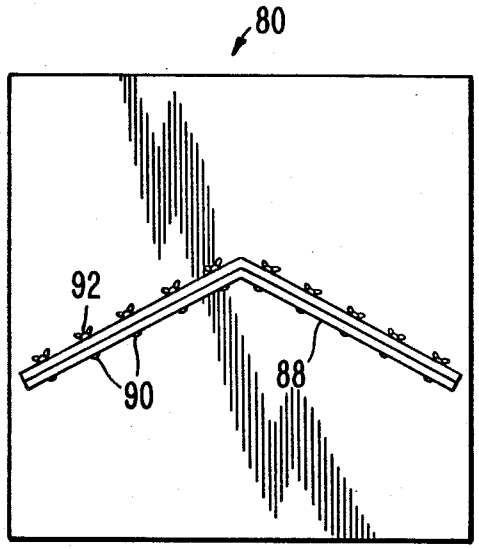
FIG. 19 shows another clamping arrangement according to the present invention.

FIG. 19 shows the tube 80 having its opening sealed by a clamp 88 defining an apex. The clamp 88 includes upper and lower members held together by bolts 90 and wing nuts 92. The apex prevents accumulation of water above the clamp 88, which is possible with the H-fold configuration of FIG. 18. The clamp 88 can also be used with tubes having other end configurations, such as the tube 10″ shown in FIG. 15.

Local variations in the thickness of the tube material lie within the scope of the invention. The bottom area could, for instance, be thicker than the remaining areas of the tube, for example, by securing an additional sheet of material to the bottom.

I claim:

1. A covering for long-term storage of heavy objects such as military equipment, armored cars, vehicles and the like, comprising:

a tube of water-repellent material, said tube having ends defined by said material, said material being continuous between said ends of said tube and having folds at each said end, said material contacting itself at each said end to define a seam at each said end; and at least one removable elongate clamp engaging material on both sides of each said seam along a line at each open end of said tube to hold closed said ends of said tube, wherein the material at each end of the tube defines at the seam a continuous edge having a length, and said at least one clamp has a length, the total clamp length at each end being less than one-half the length of the continuous edge at the seam.

2. The covering according to claim 1, wherein the continuous edge at the seam includes a first straight portion defining one side of the seam, a second straight portion defining an opposite side of the seam, and side portions positioned between and in engagement with said first and second straight portions, and said clamps engage said first and second straight portions.

3. The covering according to claim 1, wherein each said clamp includes a first surface engaging material on one side of said seam and a second surface engaging material on an opposite side of said seam, and said first and second sides of each clamp define an apex, whereby the associated seam is clamped into a corresponding apex.

4. The covering according to claim 1, wherein the tube includes a bottom having a thickness greater than the thickness of the rest of the tube.

5. The covering according to claim 1, further comprising means for facilitating the application of force to the ends of said tube for inserting the ends into said clamps, said facilitating means comprising loops attached to the material at the ends of said tube.

6. The covering according to claim 5, further comprising projections on said clamps, said loops being positioned around said projections.

7. The covering according to claim 1, further comprising a window in said material, said window comprising less than the entire covering.

8. The covering according to claim 1, further comprising means for feeding compressed air into said tube, said feeding means comprising an opening in the material for connection to a compressed air conduit.

9. The covering according to claim 1, wherein the tube is seamless between its ends.

10. The covering according to claim 1, wherein the material is an elastomer.

11. The covering according to claim 10, wherein the material is polyvinylchloride.

12. A covering for long-term storage of heavy objects such as military equipment, armored cars, vehicles and the like, comprising:

a tube of water-repellent material, said tube having ends defined by said material, said material being continuous between said ends of said tube and having folds at each said end, said material contacting itself at each said end to define a seam at each said end; and at least one removable elongate clamp engaging material on both sides of each said seam along a line at each open end of said tube to hold closed said ends of said tube, wherein the material at each end of the tube defines a continuous edge, and a plurality of apertures are defined in the material along each edge.

13. The covering according to claim 12, wherein the apertures in the material on opposite sides of each seam are in alignment with one another, and fasteners extend through the aligned apertures.

14. The covering according to claim 13, wherein apertures extend through each said clamp, and the apertures in the clamps are in alignment with the apertures in the material.

15. A covering for long-term storage of heavy objects such as a military equipment, armored cars, vehicles and the like, comprising:

a tube of water-repellent material, said tube having ends defined by said material, said material being continuous between said ends of said tube and having folds at each said end, said material contacting itself at each said end to define a seam at each said end; and at least one removable elongate clamp engaging material on both sides of each said seam along a line at each open end of said tube to hold closed said ends of said tube, wherein each clamp comprises a plurality of sections pivotally connected to one another.

* * * * *